US009394099B2

(12) United States Patent
Kimhi

(10) Patent No.: US 9,394,099 B2
(45) Date of Patent: Jul. 19, 2016

(54) DOUBLE PIZZA PACK

(76) Inventor: Yaniv Kimhi, D.N. Negev (IL)

( * ) Notice: Subject to any disclaimer, the term of this patent is extended or adjusted under 35 U.S.C. 154(b) by 115 days.

(21) Appl. No.: 13/338,284

(22) Filed: Dec. 28, 2011

(65) Prior Publication Data

US 2012/0111931 A1 May 10, 2012

Related U.S. Application Data

(63) Continuation-in-part of application No. PCT/IL2010/000805, filed on Oct. 3, 2010.

(30) Foreign Application Priority Data

Dec. 9, 2009 (IL) ..... 202628

(51) Int. Cl.
*B65D 5/42* (2006.01)
*B65D 85/36* (2006.01)

(52) U.S. Cl.
CPC ..... *B65D 85/36* (2013.01); *B65D 2585/366* (2013.01)

(58) Field of Classification Search
USPC ..... 229/120.21, 902, 904
See application file for complete search history.

(56) References Cited

U.S. PATENT DOCUMENTS

| | | | | |
|---|---|---|---|---|
| 4,836,383 | A * | 6/1989 | Gordon et al. | 229/232 |
| 4,957,237 | A * | 9/1990 | Madonna | B65D 5/48018 229/120 |
| 5,445,314 | A * | 8/1995 | Newsome | B65D 5/48014 229/120.21 |
| 6,752,311 | B2 * | 6/2004 | Tulkoff | 229/104 |
| 6,851,601 | B1 | 2/2005 | Montoya | |
| 6,905,065 | B2 | 6/2005 | Holden | |
| 6,915,949 | B1 | 7/2005 | Economopoulos | |
| 7,380,702 | B2 * | 6/2008 | Oddo | 229/104 |
| 2003/0017243 | A1 | 1/2003 | Goldman | |

* cited by examiner

*Primary Examiner* — Christopher Demeree
(74) *Attorney, Agent, or Firm* — Mark M. Friedman

(57) ABSTRACT

A double pizza pack, comprising: a single sheet comprising folding lines forming: a base plate, for use as the bottom of a lower pizza compartment; a lid plate, connected to said base plate by a first strap; a division plate, connected to said base plate by a second strap, for dividing the space between said lid plate and said base plate into two compartments; and side walls, wherein said straps being a part of said side walls; wherein the height of said first strap being twice as the height of said second strap, thereby allowing forming said pack from said single sheet, by a single punch.

15 Claims, 7 Drawing Sheets

DOUBLE PIZZA PACK

CROSS-REFERENCE TO RELATED APPLICATIONS

This application is a Continuation-in-Part of PCT International Application No. PCT/IL2010/000805, which has an international filing date of Oct. 3, 2010, and which claims priority from Israel Patent Application No. 202628, filed Dec. 9, 2009, all of which disclosures are hereby incorporated by reference.

FIELD OF THE INVENTION

The present invention relates to the field of packing and serving pizza pies. More specifically, the present invention relates to a double pizza pack that can be produced from a single sheet by a single punch.

BACKGROUND OF THE INVENTION

Pizza is very popular fast food in the west. The form of provision of pizza plays a major role in its popularity. The facts that pizza pies are baked by experts in an oven designed especially for this purpose, and usually delivered within 30 minutes from its order, have contributed to its popularity.

Delivering pizza pies from a retail shop to a client's house is usually carried out in a pack, which retains the form and warmth of the ordered pizza pie. As such, a pizza pack has to be designed such that its size provides some space between the pizza and the pack, in order to prevent contact between the top of the pizza and the cover of the pack. In addition, the pack must be made of an isolating material. Also, the material the pack should have certain stiffness, in order to keep the space between the pizza and its pack.

Pizza packs are made of flat stiff material, such as cardboard, which comprises scissions or other means that allow folding the cardboard to a pack. Pizza retailers keep the cardboards in their flat form until forming a pack from it, since this way the storage takes less space. The design of pizza packs must provide easy, fast shaping of a pack from its flat cardboard, in order to decrease the time of the process.

A substantial percentage of pizza orders are for a couple of pizza pies. In this case, it is common to deliver each pizza in an individual pack.

One of the objects of any cardboard product is to produce the product from a single sheet, by a single punch, thereby reducing the manufacturing effort.

It is an object of the present invention to provide a pack for delivery of two or more pizza pies.

Other objects and advantages of the invention will become apparent as the description proceeds.

SUMMARY OF THE INVENTION

In one aspect, the present invention is directed to a double pizza pack, comprising: a single sheet (made of, for instance, cardboard, corrugated cardboard, laminated wood, wood) comprising folding lines forming:

- a base plate, for use as the bottom of a lower pizza compartment;
- a lid plate, connected to the base plate by a first strap;
- a division plate, connected to the base plate by a second strap, for dividing the space between the lid plate and the base plate into two compartments; and
- side walls, wherein the straps being a part of the side walls;

- wherein the height of the first strap being twice as the height of the second strap, thereby allowing forming the pack from the single sheet, by a single punch.

According to one embodiment of the invention, at least one of the plates comprises separation means generating a form of a sliced pizza pie, for producing pizza servers from the lid. Each of the servers may comprise a tab, by which a user can pull the server for separation from the plate.

The pizza pack may further comprise closures for securing folded tabs, thereby providing massive structure to the pack structure.

According to one embodiment of the invention, at least one of the straps is tearable, thereby allowing separating the compartments of the pizza pack.

The pack may further comprise ventilation holes.

The pack may further comprise at least two tabs, for use as a support of the division plate.

The bottom plate may further comprise a tab, for allowing opening the lid.

According to one embodiment of the invention, at least one of the plate further comprises tabs, to be placed between a folded wall, for providing massive structure to the pack.

The foregoing embodiments of the invention are described and illustrated in conjunction with systems and methods thereof, which are meant to be merely illustrative, and not limiting.

BRIEF DESCRIPTION OF THE DRAWINGS

Embodiments and features of the present invention are described herein in conjunction with the following drawings.

Figure 1:
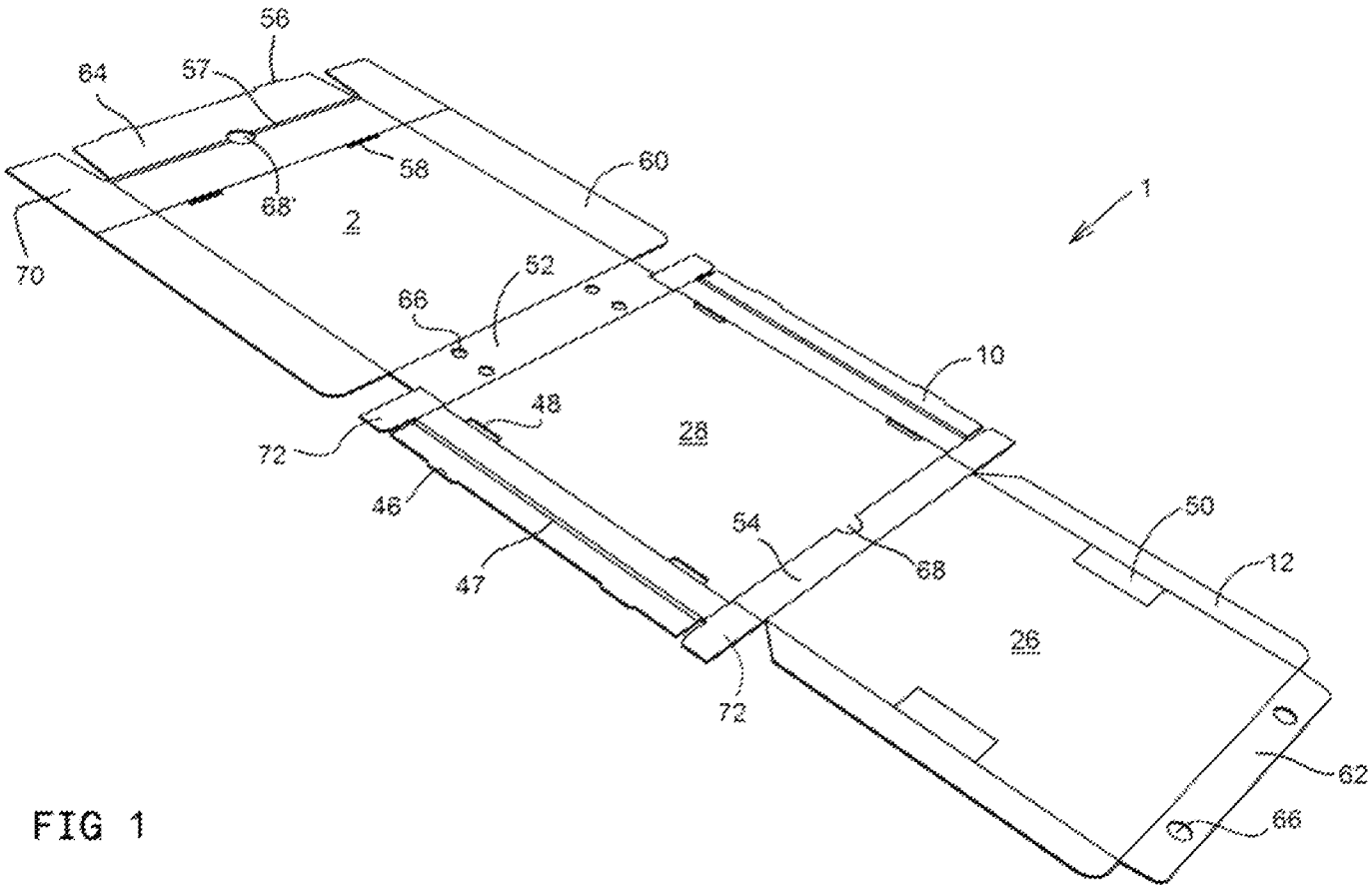
FIGS. 1 to 6 schematically illustrate a double pizza pack, according to one embodiment of the invention.

It should be understood that the drawings are not necessarily drawn to scale.

DETAILED DESCRIPTION OF THE INVENTION

The present invention will be understood from the following detailed description of preferred embodiments, which are meant to be descriptive and not limiting. For the sake of brevity, some well-known features, methods, systems, procedures, components, circuits, and so on, are not described in detail.

FIGS. 1 to 6 schematically illustrate a double pizza pack, according to one embodiment of the invention. The pizza pack is marked in these figures as 1.

The pizza pack illustrated in these figures is characterized by the fact that the entire pack is made from a single sheet, punched by a single punching operation. As this form spares the need of attaching two or more separate sheets each other, as in the other embodiments of the invention, this form is more efficient for the staff that forms the double pizza pack from the sheet.

As illustrated, the single sheet of the double pizza pack 1 comprises a lid 2, a bottom 28 of the lower pizza compartment, and a bottom 26 of the upper pizza compartment, connected each other by straps: Lid 2 is connected to bottom 28 by strap 52, and bottom 28 is connected to bottom 26 by strap 54. The straps are a part of the same sheet that lid 2, bottom 28 and bottom 26 are made of. These straps are a part of the walls of the pizza compartments.

The characteristics that allow manufacturing a double pizza pack from a single sheet is the fact that the height of strap 52 is about twice as much as the height of strap 54. In addition, walls 10 of the lower pizza compartment have the same height as strap 54, and walls 60 of the upper pizza compartment have the same height as strap 52. Thus, the bottom of the upper pizza compartment is disposed in the middle of the height of pizza pack 1.

In another words, in the embodiment illustrated in these figures, pizza pack 1 is made of a single sheet comprising folding lines forming: a base plate 28, for use as the bottom of a lower pizza compartment; a lid plate 2, connected to the base plate 28 by a first strap 52; a division plate 26, connected to the base plate 28 by a second strap 54, for dividing the space between the lid 2 and the bottom 28 into two compartments; wherein the height of the first strap 52 being twice as the height of the second strap 54, thereby allowing forming the pack from a single sheet, by a single punch.

FIG. 1 illustrates pizza pack 1 as a cut from a single sheet. In this form, all the parts of the pizza pack are seen.

Figure 2:
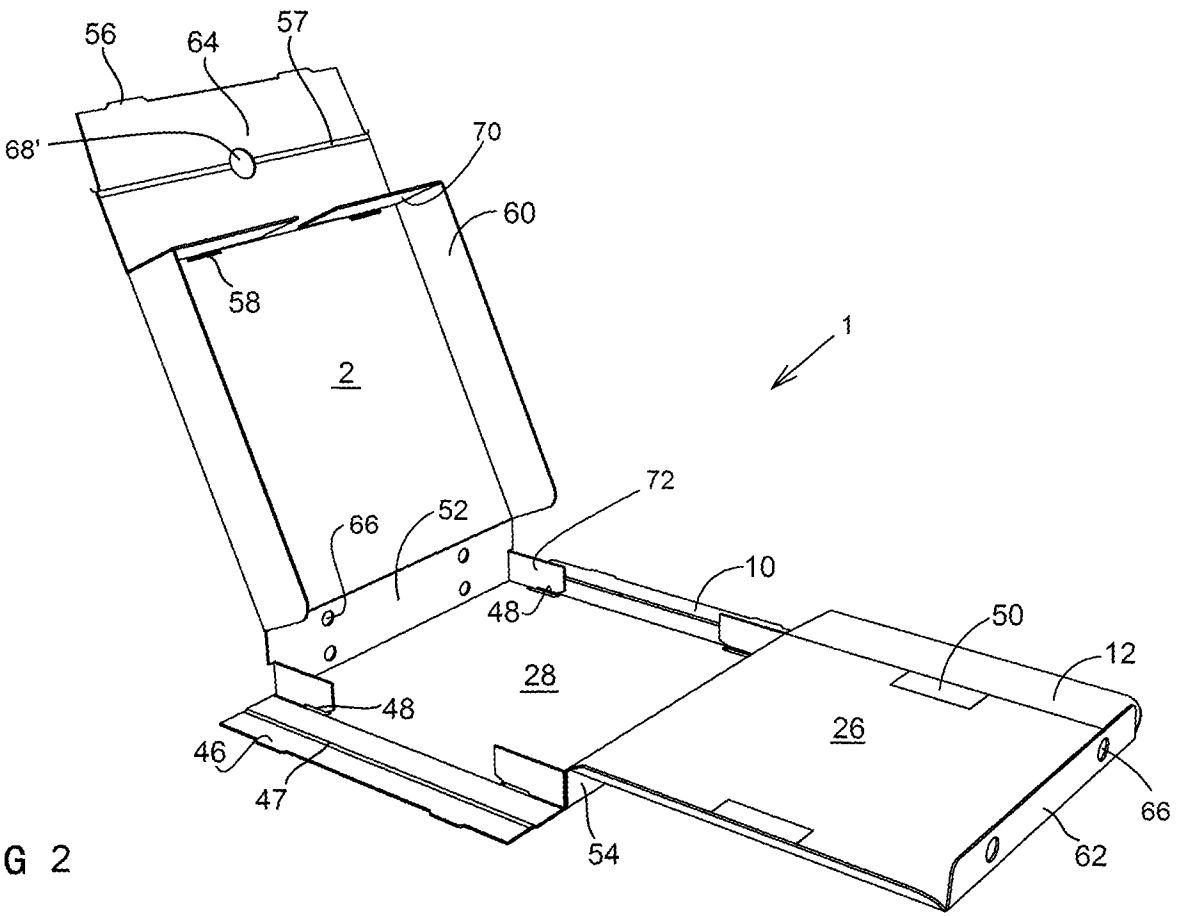

In FIG. 2 illustrates a stage in folding the flat sheet into a pizza pack.

Firstly, straps 52 and 54 are folded. Then, the lower compartment is assembled as follows:

Firstly, tabs 72 of bottom 28 are folded. Then, walls 10 are folded along folding line 47, which is disposed in about the half of its height. Each tab 72 is disposed between the corresponding folded walls 10. Wall 10 is fixed using tab 46 and its corresponding slot 48 (better seen in the magnified illustration in FIG. 3). This form provides a massive structure to the lower pizza compartment.

Lid 2 is formed in the same manner. Firstly, tabs 70 of lid 2 are folded. Then, walls 64 are folded along folding line 57, which is disposed in about the half of its height. Each tab 70 is disposed between the corresponding folded walls 64. Wall 64 is fixed using tab 56 and its corresponding slot 58. This form provides a massive structure to the lower pizza compartment.

Then, walls 12 that support bottom 26 of the upper pizza pack are folded, as illustrated in this figure.

At this stage, the double pizza pack is ready for use.

Figure 3:
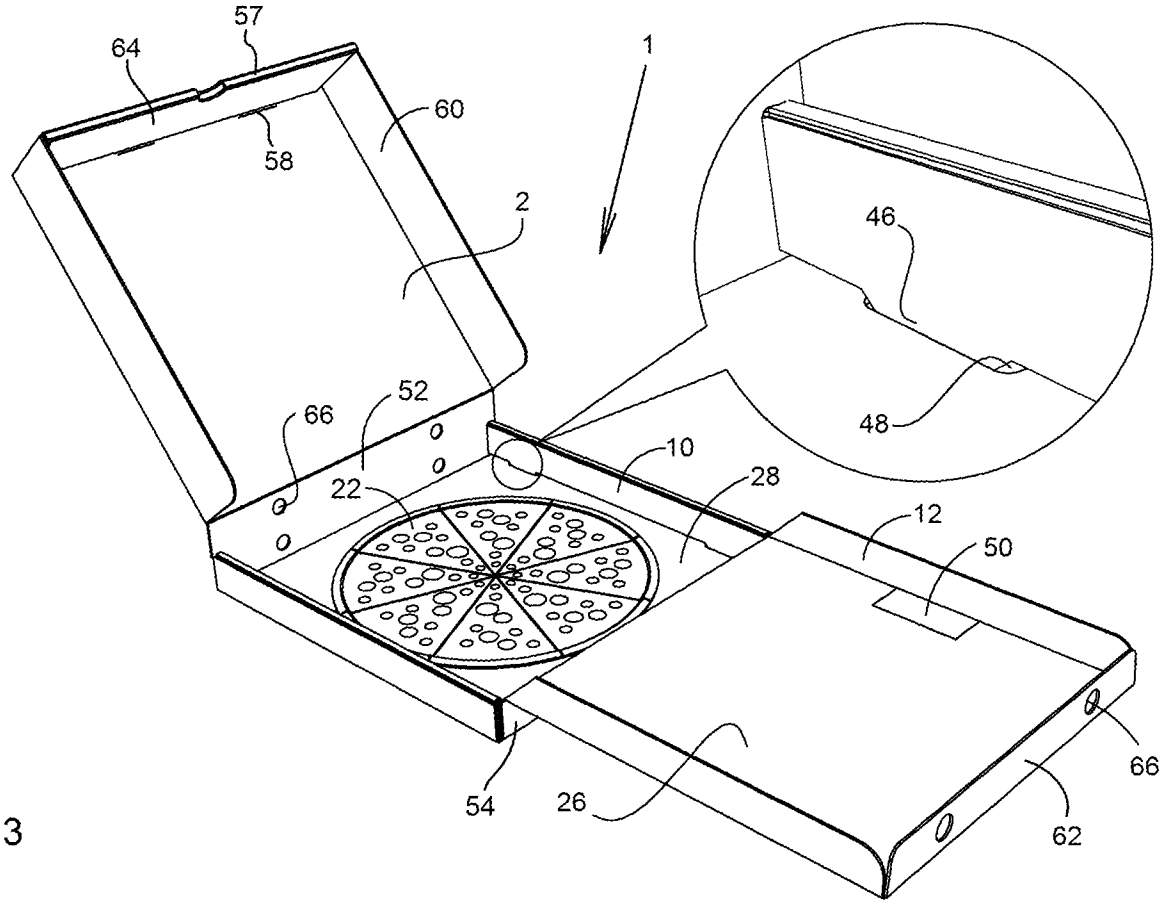

In FIG. 3, a pizza pie 22 is placed into the lower compartment. Then, element 26 is closed as a lid. Element 26 is used also as the bottom of the upper pizza compartment.

Figure 4:
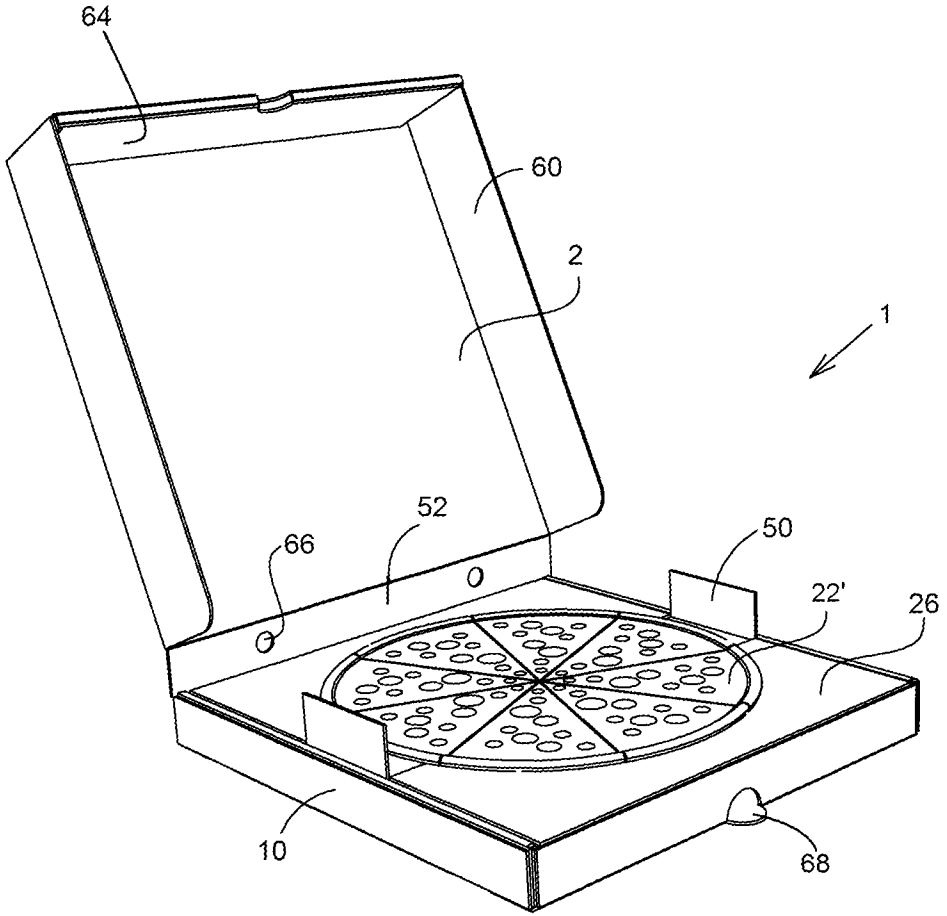

In FIG. 4, the lower compartment is closed, and the upper pizza pied 22' is placed on the bottom of the upper compartment 26.

Tab 50, which is a part of element 26, is folded in 90 degrees. In this situation, it is used as a support for lid 2, to prevent from lid 2 to touch upper pizza pie 22'. After the upper pizza pack 22' is placed, lid 22 is closed.

Figure 5:
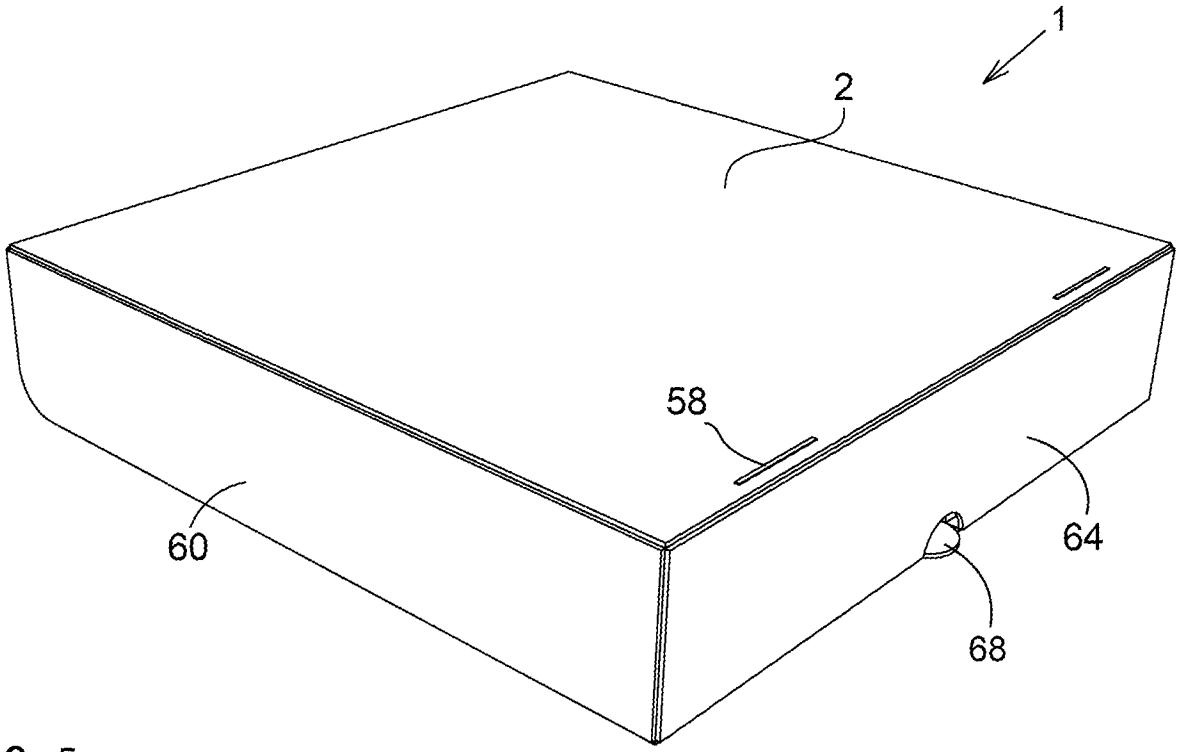

FIG. 5 illustrates the closed pizza pack.

Opening the closed pizza pack can be carried out by holding tab 68 with one hand, and pulling lid 2 upside. Tab 68 is a part of element 28, which is the bottom of the closed pizza pack.

Figure 6:
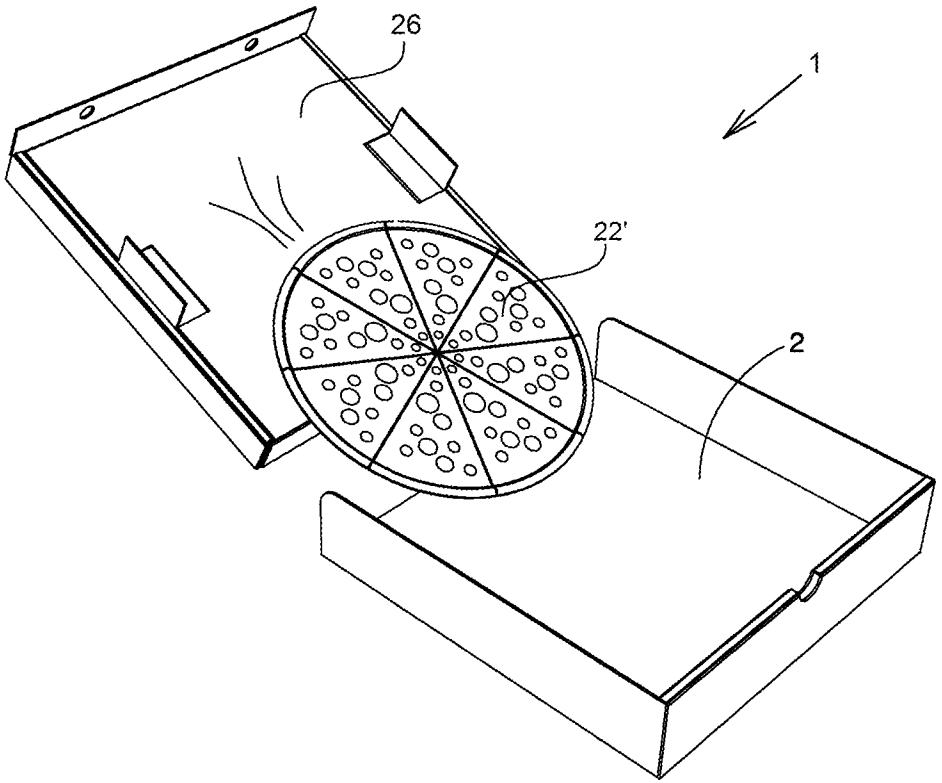

In FIG. 6, lid 2 the upper pizza pie slides into the upside-down lid 2, exposing element 26, thereby allowing opening the lower compartment. Furthermore, lid 2 can be separated from the rest of the pizza pack, resulting with two separated open compartments.

Figure 7:
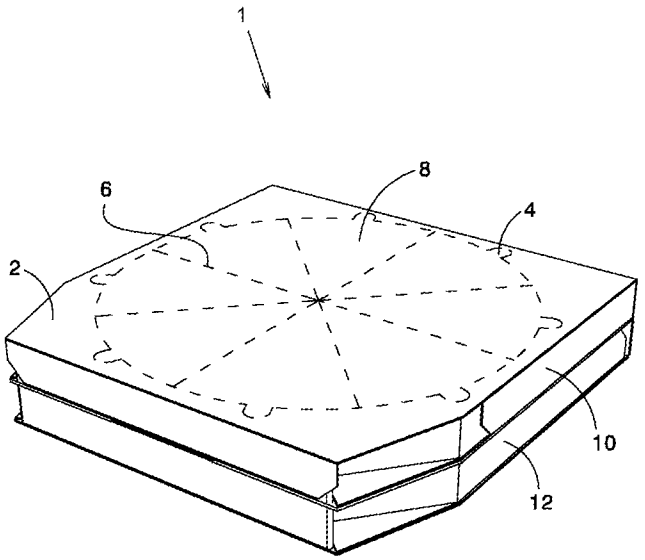
FIG. 7 schematically illustrates a pizza pack, according to a further embodiment of the invention.

FIG. 7 schematically illustrates a pizza pack, according to a further embodiment of the invention.

According to this embodiment of the invention, lid 2 is perforated by perforation 6, in a shape of slices of a pizza pie 8. Each slice 8 may comprise a tab 4. By lifting and pulling tab 4, the corresponding slice is separated from the lid. Each slice 8 can be used as a pizza slice server.

U.S. Pat. No. 6,851,601 discloses a dual pizza pie container system is provided, which includes a solid rectangular enclosure and a pizza support platform within the enclosure. The pizza support platform includes four foldable equilateral flaps which, when folded to generally right angles relative to a central base, define an octahedron having four long edges defining a virtual square and four alternating diagonal edges at corners of the support platform when folded. One of the equilateral flaps is provided with an aperture therein which effects registration with the an aperture of the fourth sidewall of the top cover of the enclosure in which widths of the equilateral sidewalls of the platform define about one-half of the height of the sidewalls of the enclosure. Thereby, upper and lower interior solid horizontal compartments, one above and one below the platform, are defined when the support platform is positioned within the enclosure and the enclosure is closed.

U.S. Pat. No. 6,915,949 discloses a rectangular box for transporting multiple pizza pies in a stacked formation formed by a single cardboard blank having scoring and cut-outs for assembling into a multiple pizza box. The box has a bottom wall, four side walls and a lid hinged to one of the side walls. When assembled the box has a pair of corner shelf supports and a removable shelf for positioning a second pizza pie. The shelf supports also provide a stop for the lid of the box to prevent crushing the contents. Both the rectangular box and a removable shelf can be stored flat when not in use.

Non of the disclosures presents a double pizza pack produced from a single sheet, by a single punch.

In the figures and/or description herein, the following reference numerals have been mentioned:

- Numeral 1 denotes a pack for two pizza pies, according to one embodiment of the invention;
- numeral 2 denotes a lid plate of pizza pack 1;
- numeral 4 denotes a tab;
- numeral 6 denotes a separation line as example of separation means (such as perforation, a cut, and so on);
- numeral 8 denotes a pizza slice server;
- numeral 10 denotes the side walls of the upper compartment of pack 1;
- numeral 12 denotes the side walls of the lower compartment of pack 1;
- numeral 22 denotes a pizza pie in the lower compartment;
- numeral 22' denotes a pizza pie in the upper compartment;
- numeral 26 denotes the bottom plate of the upper pizza compartment;
- numeral 28 denotes the bottom plate of the lower pizza compartment;
- numeral 46 denotes a tab;
- numeral 48 denotes a slot, which forms with tab 46 a closure which keeps wall 10 folded;
- numeral 50 denotes a tab in element 26, which when folded to form a 90 degrees with element 26, it prevents lid 2 to be in contact with the upper pizza pie;
- numeral 52 denotes a strap connecting lid 2 with element 28;
- numeral 54 denotes a strap connecting element 28 with element 26;
- numeral 56 denotes a tab;
- numeral 58 denotes a slot, which forms with tab 56 a closure which keeps wall 64 folded;
- numeral 60 denotes the walls of lid 2;
- numeral 62 denotes a wall connected to element 26;
- numeral 64 denotes a wall connected to element 2;
- numeral 66 denotes a ventilation hole;
- numeral 68 denotes a tab;
- numeral 68' denotes a hole, corresponding to tab 68;
- numeral 70 denotes a tab used for forming the box form of lid 2; and numeral 72 denotes a tab used for forming the box form of the lower pizza compartment.

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

What is claimed is:

1. A container for holding pizza, comprising:

a single sheet, foldable into the container, comprising:

a base plate including laterally disposed flanges, the laterally disposed flanges foldable over on themselves;

a lid plate including oppositely disposed foldable flanges which include oppositely disposed foldable tabs, and an adjacent foldable flange, foldable over itself to receive the oppositely disposed foldable tabs, the foldable flanges extending outward, such that when folded, the foldable flanges envelop the folded over laterally disposed flanges of the base plate, when the single sheet is formed into the container;

a first intermediate portion between the base plate and the lid plate, and including oppositely disposed first and second folds, the first fold at the interface of the first intermediate portion with the base plate, such that the oppositely disposed first fold defines a hinged attachment for the base plate and the first intermediate portion, and the second fold at the interface of the first intermediate portion with the lid plate, such that the oppositely disposed second fold defines a hinged attachment for the lid plate and the first intermediate portion;

a division plate including a plurality of peripherally disposed foldable flanges that fold;

a second intermediate portion between the division plate and the base plate, the second intermediate portion including oppositely disposed folds at each respective interface of the second intermediate portion with the base plate and the division plate, the division plate, when folded over the base plate via the second intermediate portion oppositely disposed folds, remaining part of the single sheet, and forming at least two compartments in the container, the plurality of foldable flanges of the division plate foldable such that the division plate is self supporting when the single sheet is formed into the container; and, wherein the height of first intermediate portion is defined by the oppositely disposed first and second folds, and is greater than the height of said second intermediate portion.

2. The container of claim 1, wherein the lid plate includes perforations in a prearranged configuration, for separation from the lid plate.

3. The container of claim 2, wherein the predetermined configuration includes a rounded periphery with a plurality of diameters extending therethrough, to define a plurality of servers for a food item in multiple portions.

4. The container of claim 3, wherein the a rounded periphery with a plurality of diameters extending therethrough, to define a plurality of servers for a food item in multiple portions, the food item including a pizza in multiple slices.

5. The container of claim 4, wherein each of the servers comprises a gripping tab for separation of each of the servers from the lid plate.

6. The container of claim 1, wherein at least one of the first intermediate portion or the second intermediate portion is tearable, thereby allowing separating the at least compartments of the container.

7. The container of claim 1, wherein the single sheet is selected from a group consisting of cardboard, corrugated cardboard, laminated wood, and, wood.

8. The container of claim 1, wherein the first intermediate portion includes ventilation holes.

9. The container of claim 1, wherein the division plate includes laterally disposed foldable elements, which when folded toward the lid plate serve as a stop surface for the lid plate when the single sheet is formed into the container.

10. The container of claim 1, wherein the base plate further comprises a tab foldable into an outwardly protruding position, and the lid plate includes an opening formed in the folded over adjacent flange, the opening for receiving the tab in the outwardly position to hold the lid plate in a closed position.

11. The container of claim 1, wherein the height of the first intermediate portion is at least twice the height of the second intermediate portion.

12. The container of claim 1, wherein the division plate includes laterally disposed slats foldable in the direction of the lid plate to serve as a stop surface for the lid plate.

13. The container of claim 1 wherein each of the at least two compartments are configured for accommodating a pizza.

14. A method for producing a container for holding a plurality of pizzas, comprising:

providing a single sheet of material; and, punching the single sheet of material to render the punched single sheet of material such that it is foldable into the container, and the punched single sheet of material comprises:

a base plate including laterally disposed flanges, the laterally disposed flanges foldable over on themselves;

a lid plate including oppositely disposed foldable flanges which include oppositely disposed foldable tabs, and an adjacent foldable flange, foldable over itself to receive the oppositely disposed foldable tabs, the adjacent foldable flange positioned intermediate the oppositely disposed foldable flanges, the foldable flanges extending outward, such that when folded, the foldable flanges envelop the folded over laterally disposed flanges of the base plate, when the single sheet is formed into the container;

a first intermediate portion between the base plate and the lid plate, and including oppositely disposed first and second folds, the first fold at the interface of the first intermediate portion with the base plate, such that the oppositely disposed first fold defines a hinged attachment for the base plate and the first intermediate portion, and, the second fold at the interface of the first intermediate portion with the lid plate, such that the oppositely disposed second fold defines a hinged attachment for the lid plate and the first intermediate portion;

a division plate including a plurality of peripherally disposed foldable flanges that fold;

a second intermediate portion between the division plate and the base plate, the second intermediate portion including oppositely disposed folds at each respective interface of the second intermediate portion with the base plate and the division plate, the division plate, when folded over the base plate via the second intermediate portion oppositely disposed folds, remaining part of the single sheet, and forming at least two compartments in the container, the plurality of foldable flanges of the division plate foldable such that the division plate is self supporting when the single sheet is formed into the container; and, wherein the height of the first intermediate portion is defined by the oppositely disposed first and second folds, and is greater than the height of said second intermediate portion.

15. The method of claim 14, wherein each of the at least two compartments accommodate a pizza.

* * * * *